US006378818B1

(12) United States Patent
Padiak et al.

(10) Patent No.: US 6,378,818 B1
(45) Date of Patent: Apr. 30, 2002

(54) MULTI-POSITION SIGN-MOUNTING SYSTEM

(75) Inventors: Scott Padiak, Winnetka; Paul C. Evans, Chicago, both of IL (US)

(73) Assignee: Cormark, Inc., Elk Grove, IL (US)

( * ) Notice: Subject to any disclaimer, the term of this patent is extended or adjusted under 35 U.S.C. 154(b) by 0 days.

(21) Appl. No.: 09/578,937

(22) Filed: May 25, 2000

(51) Int. Cl.[7] ..... G09F 19/14

(52) U.S. Cl. ..... 248/201; 248/548; 248/417; 40/606; 40/661.06

(58) Field of Search ..... 248/351, 316.8, 248/201, 548, 417; 40/606, 124, 661.06; 403/106, 112, 113, 120, 83, 84, 103, 111; 16/334, 332, 307; 211/69.6, 69.7, 119.06

(56) References Cited

U.S. PATENT DOCUMENTS 1,995,656 A * 3/1935 Stout ..... 248/19
2,787,433 A * 4/1957 Slavsky et al. ..... 248/204
4,323,162 A * 4/1982 Steinhilber ..... 211/100
4,527,760 A * 7/1985 Salacuse ..... 248/108
4,881,707 A * 11/1989 Garfinkle ..... 248/221.4
4,909,464 A * 3/1990 Levine et al. ..... 248/225.1
5,452,875 A * 9/1995 Kern ..... 248/242
6,012,244 A * 1/2000 Begum et al. ..... 40/661.03
6,233,102 B1 * 5/2001 Hogan, Jr. ..... 359/802

* cited by examiner

*Primary Examiner*—Leslie A. Braun
*Assistant Examiner*—Steven Marsh
(74) *Attorney, Agent, or Firm*—Welsh & Katz, Ltd.

(57) ABSTRACT

A sign-mounting system for mounting a sign to a structure, includes a frame portion mountable to the sign and a mounting portion mountable to the structure. The system can be symmetrical with each side having coupling elements of the frame and mounting portions which include generally circular rims which fit generally concentrically one within the other. Each rim has locking parts of different radius than adjacent portions of that rim, and the locking parts of respective rims engage to resist rotation. The locking parts can be configured so that resistance to rotation occurs at a plurality of orientations. The respective locking parts can be of different arc lengths to provide a limited range of rotation before the locking parts resist rotation, and a spring can bias rotation in one direction. At least one of the coupling elements can be reversible with two opposite-facing rims.

19 Claims, 7 Drawing Sheets

20
212
40
41
α

MULTI-POSITION SIGN-MOUNTING SYSTEM

FIELD OF THE INVENTION

This invention pertains to a multi-position sign-mounting system. More particularly, the invention pertains to a sign-mounting system that permits a sign to be snap-locked into different positions, and also permits a sign to rotate over a limited range and spring back to an initial position.

BACKGROUND OF THE INVENTION

Signs, and more particularly point-of-purchase sign or display systems can, when properly designed, be tremendously effective marketing tools. As such, these point-of-purchase sign or display systems have become widely popular in all manner of retail trades.

There are an extremely large number of different types of point-of-purchase displays and signs. These displays vary from active, e.g. rotating displays used to display, for example, eyewear, to the more traditional, passive or stationary signs such as overhead signs.

Consumers also will recognize the fast-paced growth of the home improvement center retail market, as well as the increasing number of "warehouse club" types of establishments. Many of these establishments use conventional warehouse-type stocking arrangements. That is, they use shelving systems that permit loading of pallets and palletized items onto the stocking shelves.

Although these pallet-type stocking arrangements permit the storage of large items and a large amount of items on each of the shelves, in many instances, they do not lend themselves to the mounting of point-of-purchase displays or signs onto these shelving systems.

Typically, these point-of-purchase displays are permanently or semi-permanently affixed to the shelves themselves, are hung in aisles between shelving systems or racks, or are hung above the shelving systems and angled downwardly so that consumers may view the signs as they pass between the shelving racks. While many of these signs work quite well insofar as directing consumers' attention to particular products, they do not permit ready access to the shelves in order to, for example, restock the shelves. This, of course, is particularly true of those signs that are permanently or semi-permanently affixed to the shelves.

One known type of mounting system has a pivoting mount that includes a bracket that is permanently affixed to a vertical surface of the shelf system, and an upwardly extending arm connected to the bracket. A leg extends horizontally outwardly from the arm and includes a pivoting head portion attached to an end of the leg. A sign is mounted to the pivoting head portion so that the sign and head can be pivoted relative to the extension arm and leg.

The mounting system includes various pieces of hardware that are used to lock the sign and pivoting head into a desired position. Although such a sign support or mounting system may function well, it has a number of drawbacks. First, there is a large quantity of small hardware items that are required to mount the sign in a given position. Such small hardware items are easily lost or misplaced while the sign is pivoted to reposition the sign or to restock the shelves.

Another drawback is that the sign cannot be fully pivoted out of the way in order to restock a shelf. That is, when the sign is pivoted out of the way, it is typically pivoted and positioned horizontally, and can project outwardly, into for example an aisle. This "resting" position of the sign can create a personnel hazard, as well as place the sign in a position in which it can be damaged by passing equipment such as a forklift.

Other types of sign mounting systems are known in the art. However, such systems suffer from many of the same drawbacks as the aforementioned pivoting display mount. That is, small hardware items are necessary to position the sign in a particular, desired position, and/or the sign may not be fully pivotal out of the way of consumers, personnel working nearby, or equipment that may be used in proximity to the pivoted sign.

Accordingly, there exists a need for a point-of-purchase display or sign-mounting system that is used to position a sign in a particular, desired orientation and position, and that is effective for point-of-purchase marketing. Desirably, such a system permits rotating or pivoting the sign out of the way, from a display position to a storage position, to restock a shelf over which the sign is located, and also permits the sign to yield (such as when struck accidently by a forklift) without damage and spring back to its initial position. Desirably, such a mounting system requires no tools to pivot the sign from a display position to a storage position.

BRIEF SUMMARY OF THE INVENTION

The present sign-mounting system includes a frame portion and a mounting portion. The mounting portion is mountable to a structure, such as a shelf, a shelf-support, a vertical column, an overhead beam, or the like. The frame portion is mountable to a sign to be displayed.

The mounting portion and the frame portion are coupled to each other by coupling elements. In one embodiment, the system is symmetrical, with a pair of mirror image coupling elements on each side. There can be two mounting portions, and the frame portion can have a separate coupling elements coupled to each of the coupling elements of the mounting portions.

The frame portion can have at least one extension element which is mountable to the sign. In one embodiment, the extension element can be telescopically adjustable.

Each of a pair of coupling elements (one on the mounting portion and one on the frame portion) includes a generally circular rim. The two rims are of different diameters and fit generally concentrically one within the other. A surface of each rim has at least one locking part which is raised above or depressed below the surrounding surface (i.e., has a larger radius than or a smaller radius than the surrounding, adjacent surface). The locking parts of the two rims can be engaged to resist rotation of coupling elements relative to each other. In this condition, the system is in a snap-lock position.

The system can be sufficiently flexible to allow the frame portion to be rotated (with respect to the mounting portion) out of a snap-lock position, without the use of tools. In one embodiment, at least one of the rims has a plurality of locking parts so that there can be a plurality of snap-lock positions. In this configuration, the frame portion can be rotated from one snap-lock position to another snap-lock position. In that way, a sign which is initially in a snap-lock position for best display visibility by customers can be rotated to a snap-lock position which is out of the way for restocking, and can be rotated back to the initial position. The sign is readily rotated between display and restocking positions without the use of tools.

In one embodiment, respective locking parts (e.g., raised or lowered sections) of the two rims can be of different arc lengths, yielding a limited range of rotation before the locking parts resist rotation of the coupling elements relative to each other. Ends of a spring, such as a spiral spring, can be in contact, respectively, with the two coupling elements, and the spring can bias rotation in one direction. As a result, a sign can rotate freely when pushed, and then spring back to its initial position. This is especially useful when a sign is susceptible to being hit accidently such as by a fork lift. The sign can yield instead of being damaged, and then can spring back.

In one embodiment, at least one of a pair of coupling elements can be reversible with two opposite-facing rims. Each of two rims on one coupling element could provide for different snap-lock positions and/or different options for free rotation with spring return. The rim best suited for the particular application would be coupled.

Other features and advantages of the present invention will be apparent from the following detailed description, in conjunction with the accompanying drawings, and the appended claims.

DETAILED DESCRIPTION OF THE PREFERRED EMBODIMENT

Figure 1:
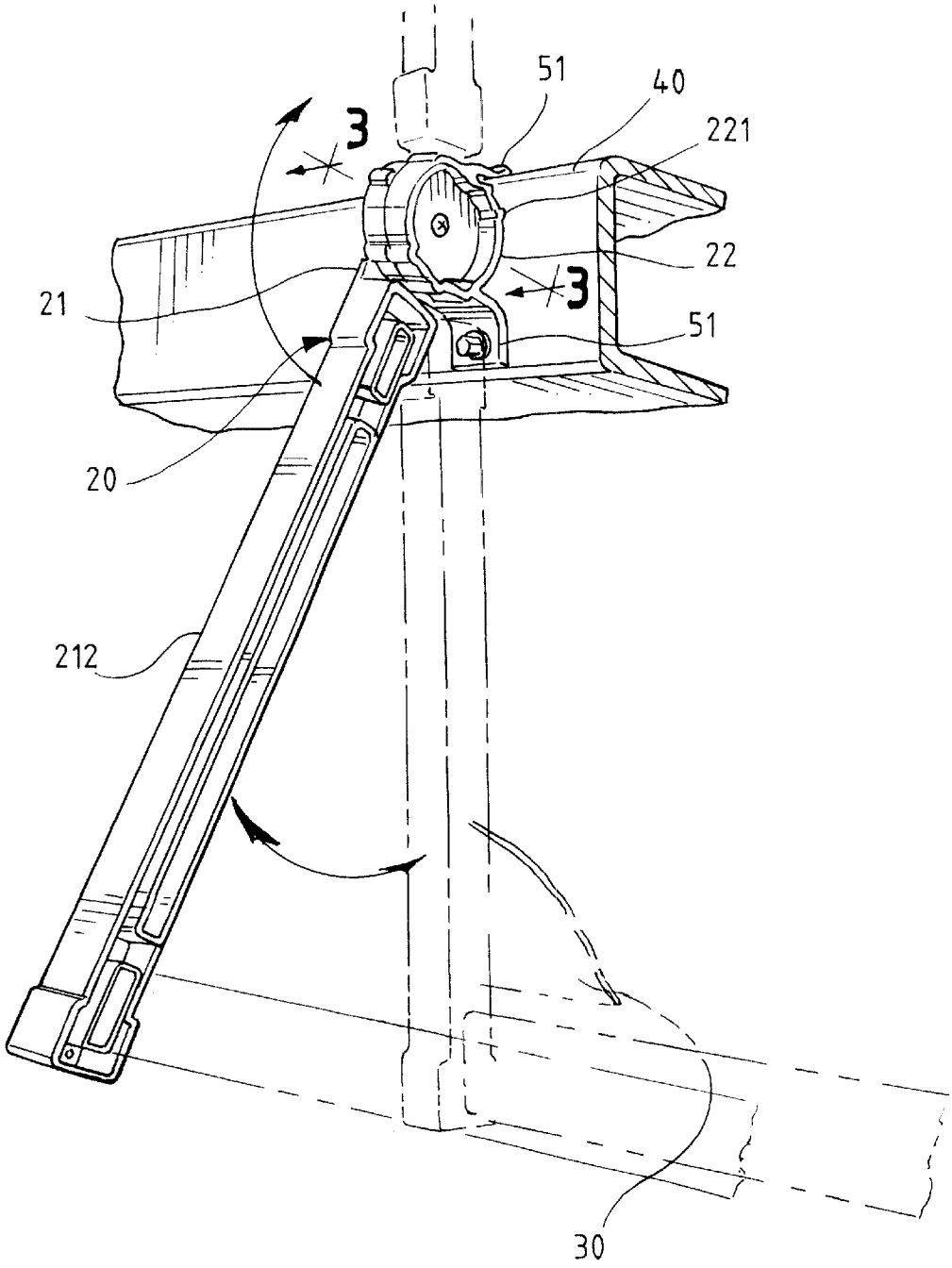
FIG. 1 is a perspective view of an embodiment of a multi-position sign mounting system embodying the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures, FIG. 1 is a perspective view of an embodiment of a multi-position sign mounting system 20 embodying the principles of the present invention. The system 20 is used to mount a sign 30 to a structure 40, such as a pallet rack horizontal beam, a vertical support standard, or the like. The system 20 includes a frame portion 21 mountable to the sign 30, and a mounting portion 22 mountable to the structure 40.

Figure 1A:
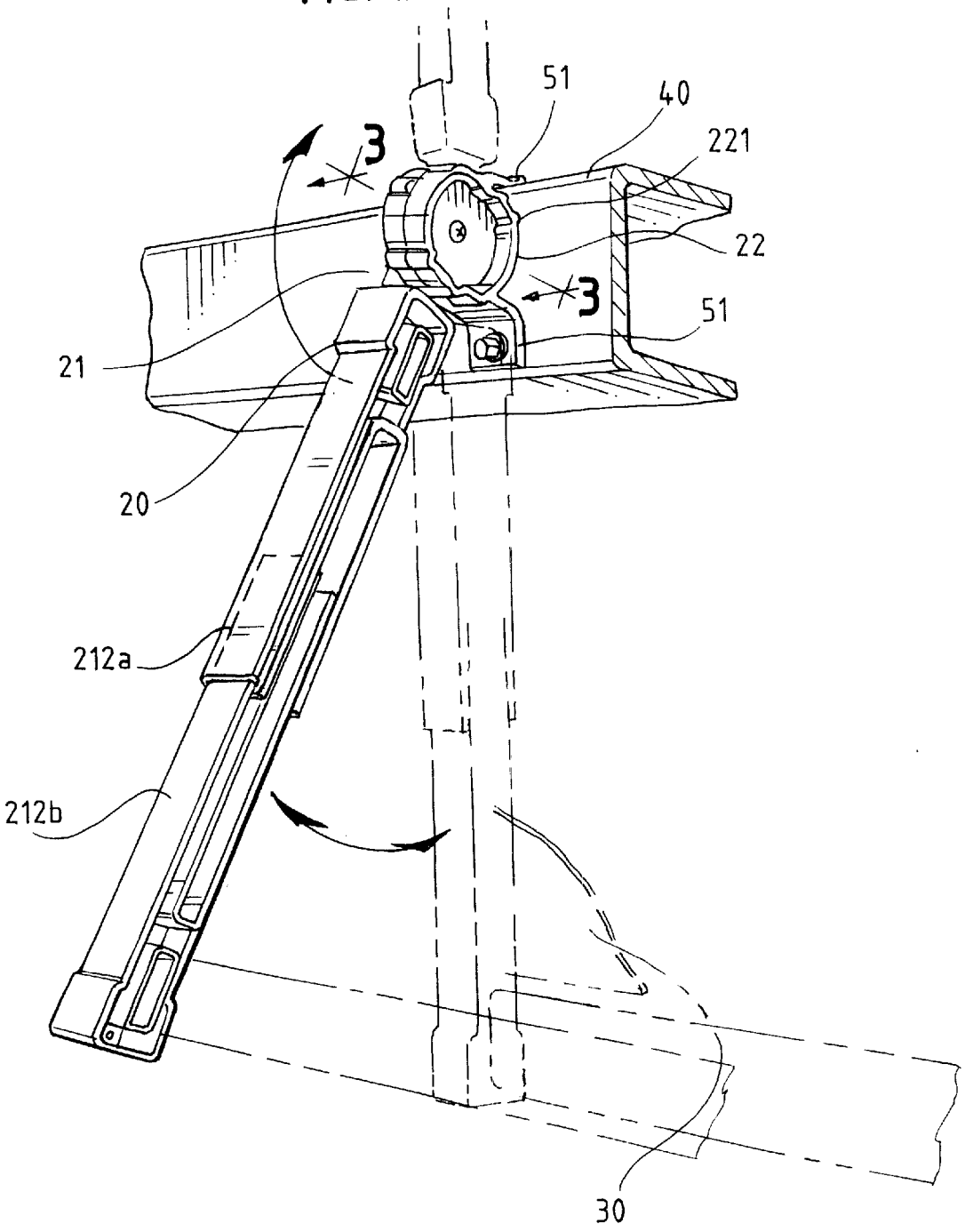
FIG. 1*a* is a perspective view similar to FIG. 1, illustrating an embodiment with an adjustable extension element.

The frame portion 21 includes a coupling element 211 and an extension element 212. The extension element 212 can be mountable to the sign 30, or can form a portion of a frame onto which the sign 30 is mounted. In one embodiment of FIG. 1*a*, extension element 212 can be adjustable to different lengths. For example, extension element 212 can be adjustable telescopically.

The mounting portion 22 includes a coupling element 221, and connecting points 51 for mounting the mounting portion 22 to the structure 40. There can be a plurality of connecting points 51. In one embodiment, there can be sufficient connecting points 51 in different positions to enable mounting the system 20 at different orientations with respect to the structure 40, such as the orientations illustrated in FIGS. 7 through 10.

The coupling elements 211 and 221 can include generally circular rims which fit together, joining the frame portion 21 and the mounting portion 22 in a generally concentric coupling relation. Either one of coupling elements 211 and 221 can have the larger diameter. For discussion purposes, the present description provides that coupling element 221 of the mounting portion 22 has the larger diameter. However, those skilled in the art will recognize that coupling element 211 can be formed having the larger diameter, and that such arrangement is within the scope and spirit of the present invention.

Figure 5:
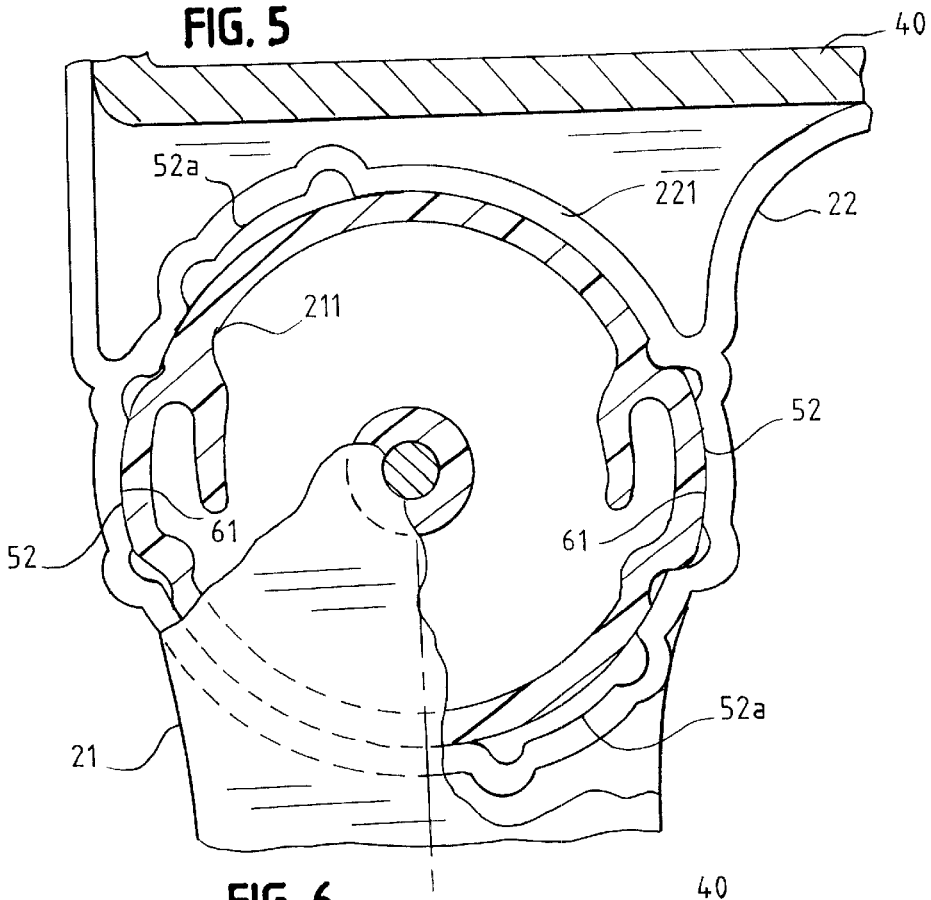
FIG. 5 is a partial side view of one embodiment of the frame portion coupled to the mounting portion in a snap-lock position arrangement, with part of the frame portion coupling element cutaway, and with the frame portion in a first orientation with respect to the mounting portion.
Figure 6:
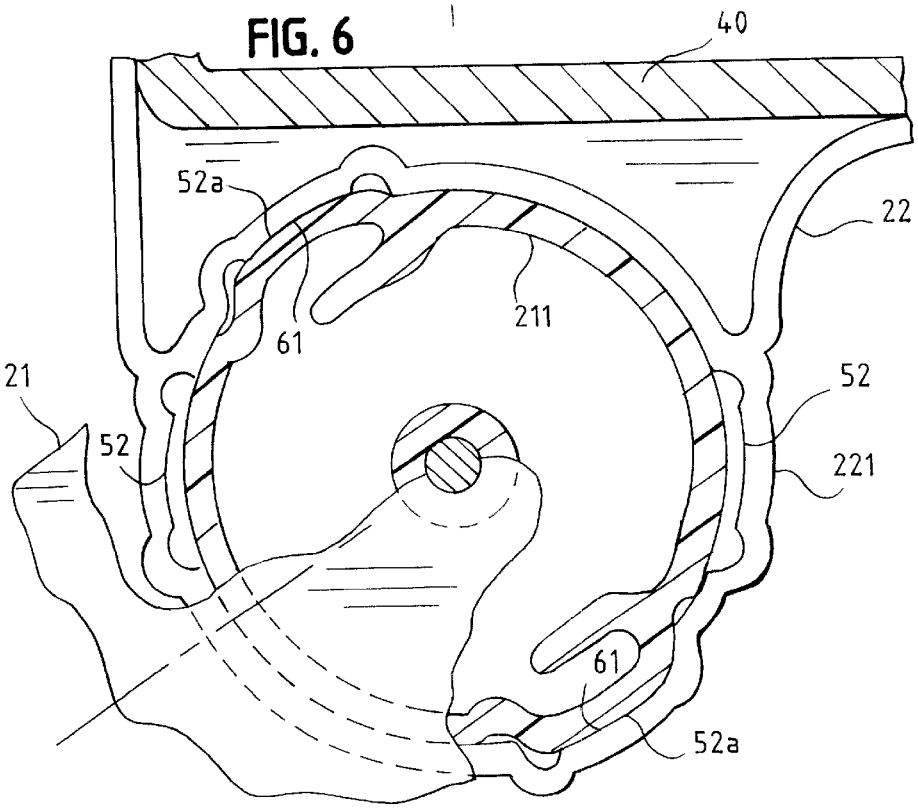
FIG. 6 is a partial side view similar to FIG. 5, with the frame portion in a second orientation with respect to the mounting portion.

In a snap-lock position arrangement, as illustrated in the examples of FIGS. 5 and 6, an outside surface of a rim of coupling element 211 can have at least one inner locking part 61, which is of a different radius than adjacent portions of the outside surface of that rim. Similarly, an inside surface of a rim of coupling element 221 can have at least one outer locking part 52, 52*a* which is of a different radius than adjacent portions of the inside surface of that rim. The inner and outer locking parts 61 and 52, 52*a* can be engaged in a tongue-in-groove like arrangement to resist rotation of the coupling elements 211 and 221 with respect to each other.

In the examples of FIGS. 5 and 6, the inner and outer locking parts 61 and 52, 52*a* each have a larger radius than adjacent portions of the outside surface of a rim of coupling element 211 and the inside surface of of a rim of coupling element 221, respectively. Alternatively, although not shown, each can be formed having a smaller radius, respectively, as long they can be engaged to resist rotation and establish a snap-lock position.

In the examples of FIGS. 5 and 6, there are two diametrically opposed inner locking parts 61, and two pair of diametrically opposed outer locking parts 52 and 52*a*. Consequently, there are two snap-lock positions in the examples of FIGS. 5 and 6. FIG. 5 illustrates the frame portion 21 in one orientation with respect to the mounting portion 22, and FIG. 6 illustrates the frame portion 21 in a second orientation with respect to the mounting portion 22. FIGS. 5 and 6 are simply illustrations, and a variety of other snap-lock positions are possible and are within the scope of the present invention.

In one embodiment, the coupling elements are sufficiently flexible to allow rotation from one snap-lock position to another without disassembly of the system 20, but are also sufficiently rigid and resilient to resist the sign 30 rotating from a snap-lock position. In other words, without the need for tools or disassembly, the coupling elements 211 and 221 can be rotated relative to one another to a different snap-lock position, by applying force to the frame portion 21. For example, coupling elements 211 and 221 can be rotated relative to one another from the orientation seen in FIG. 5 to the orientation seen in FIG. 6. Inner locking parts 61 would be disengaged from the outer locking parts 52 as seen in FIG. 5 and engaged with the outer locking parts 52*a* as seen in FIG. 6. However, inner and outer locking parts 61 and 52*a* will remain in that snap-lock position until coupling elements 211 and 221 are rotated again. For example, this can be achieved with coupling elements 211 and 221 composed of a polymeric material such as polypropylene, which can be formed in an injection molding process.

Figure 3:
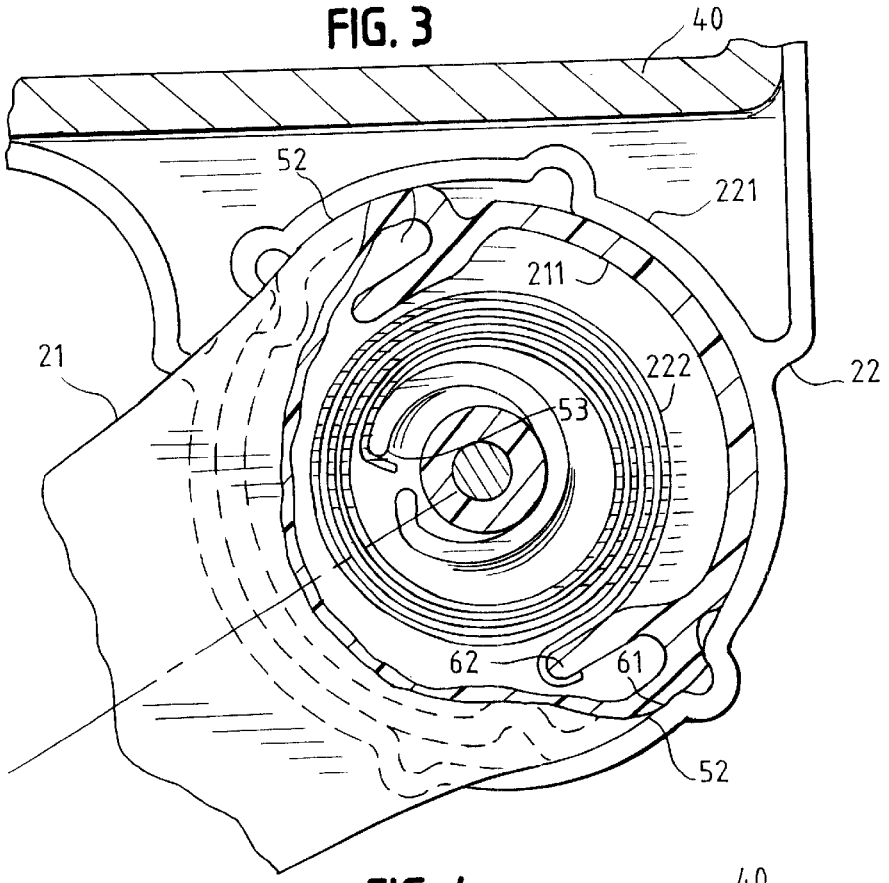
FIG. 3 is partial side view taken along line 3—3 of FIG. 1, illustrating the frame portion coupled to the mounting portion in a free rotation and spring return arrangement, with part of the frame portion coupling element cut-away, and with the frame portion in a rest position.
Figure 4:
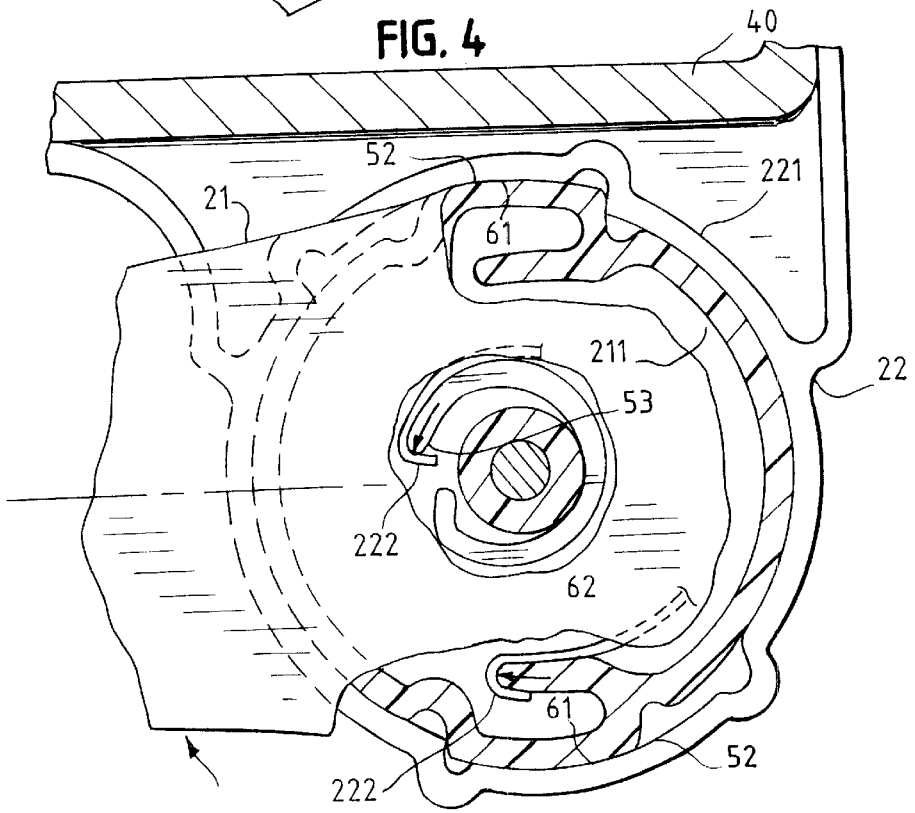
FIG. 4 is a partial side view similar to FIG. 3, with the frame portion in a pivoted position.

In a free rotation with spring return arrangement, as illustrated in the examples of FIGS. 3 and 4, at least one of the at least one inner locking parts 61 has a different arc length than at least one of the at least one outer locking parts 52. In the examples of FIGS. 3 and 4, the outer locking part 52 is the "groove" and the inner locking part 61 is the "tongue," so the outer locking part 52 has a greater arc length than the inner locking part 61. In this arrangement, there is a limited range of rotation before the inner and outer locking parts 61 and 52 resist rotation of the coupling elements 211 and 221 relative to each other. A spring 222 can bias rotation of the coupling elements 211 and 221 relative to each other in one direction. In that way, a sign 30 will pivot through a limited range of rotation (instead of being damaged when hit by a person or a fork lift, for example), and then will spring back to the desired position.

Figure 2:
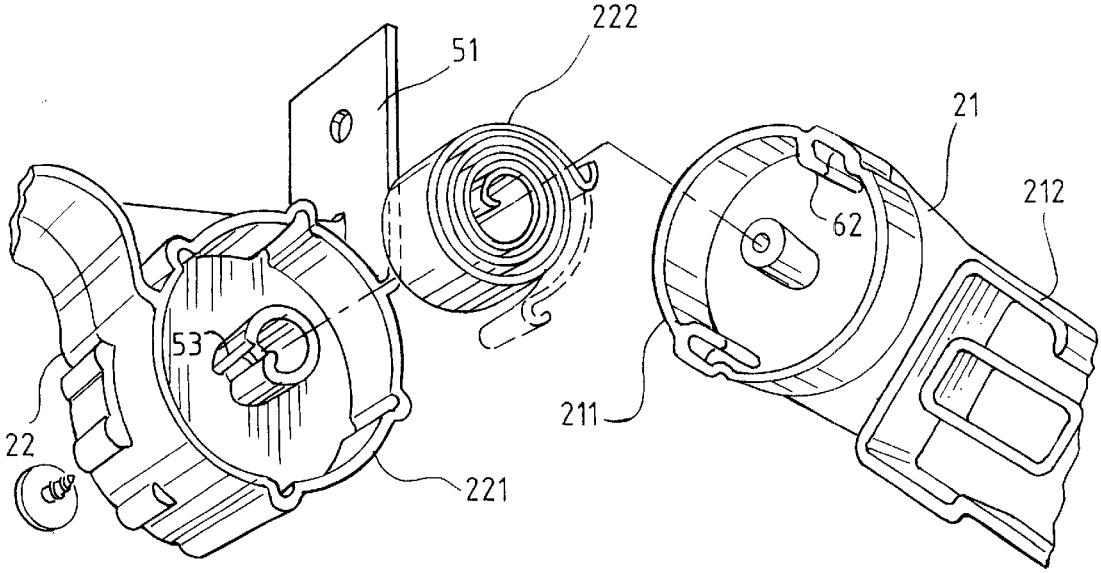
FIG. 2 is an exploded view, illustrating the arrangement of components of the mounting system of FIG. 1 fitting together in a free rotation with spring return arrangement.

FIG. 2 is an exploded view, illustrating the components fitting together in a free rotation with spring return arrangement. FIG. 4 illustrates the frame portion 21 in a pivot position relative to the mounting portion 22, such as when the sign 30 has been pushed against the force of the spring 222 within the limited range of free rotation before the inner and outer locking parts 61 and 52 resist rotation of the coupling elements 211 and 221. FIG. 3 illustrates the frame portion 21 in a rest position relative to the mounting portion 22, such as after the spring 222 returns the sign 30 to its initial position permitted by the inner and outer locking parts 61 and 52.

The examples of FIGS. 2, 3, and 4 illustrate a spirally compressed spring 222, but other types of springs such as a longitudinally compressed or longitudinally stretched spring could be used as well. In the examples of FIGS. 2, 3, and 4, one end of the spring 222 contacts a hook 62 of coupling element 211, and the other end of spring 222 contacts a hook 53 of coupling element 221. In the examples of FIGS. 2, 3, and 4, spring 222 is located concentrically inside of a rim of coupling element 211, and hook 53 of coupling element 221 extends up concentrically inside of spring 222. However, other physical arrangements can be used as long as spring 222 can bias rotation of the coupling elements 211 and 221 relative to each other in one direction.

In different embodiments, there can be different combinations of the arrangements discussed above. For example, coupling elements 211 and 221 could be constructed to provide both the snap-lock position option and the free rotation with spring return option. As another example, coupling element 221 and/or coupling element 211 could have an opposite-facing second rim with different options. The different options could, for example, be different orientations of the coupling element 211 relative to coupling element 221, or one rim could provide snap-lock positions and the other rim could provide free rotation with spring return. The rims chosen for coupling could depend on the particular application of the system 20. FIGS. 1 and 2 illustrate coupling element 22 having two opposite-facing rims.

Figure 11:
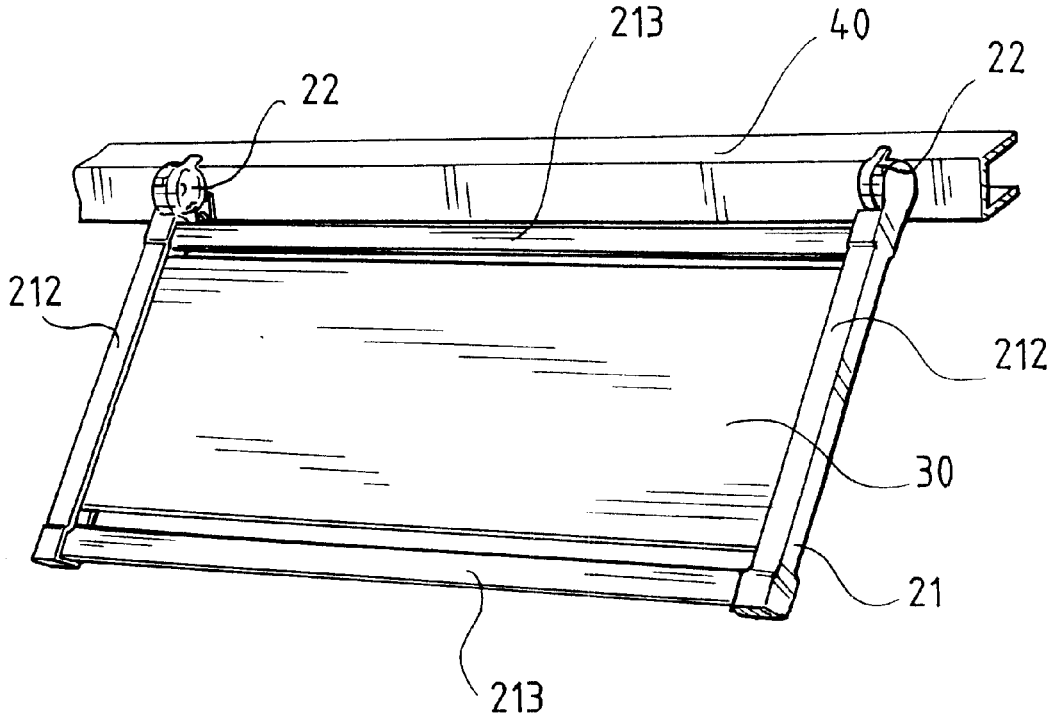
FIG. 11 is a perspective view of an embodiment with mirror image coupling elements, and a pair of extension elements supporting a sign between them.

Different embodiments can include a pair of mirror image coupling elements 211, and a pair of mirror image coupling elements 221 with a pair of extension elements 212 supporting a sign 30 between them. For example, FIG. 11 shows two mounting portions 22 mounted on a structure 40. Framing portion 21 is coupled to both mounting portions 22, and includes two extension elements 212 joined by central elements 213. Sign 30 is mounted in the frame formed by extension elements 212 and central elements 213. In one embodiment, the central elements can be formed in an extrusion process and cut in different lengths to accommodate different size signs 30.

In one embodiment, the coupling element 221 of each of two mounting portions 22 can include two opposite facing rims with different options (i.e., different combinations of snap-lock positions and/or free rotation with spring return). The possible sign positions could be altered quickly without removing the mounting portions 22 from the structure 40, but simply by recoupling the coupling elements 211 of a framing portion 21 with the outer-facing rims instead of the inner-facing rims of coupling element 221 (or vice versa). In other embodiments, two coupling elements 211 of framing portion 21 could each include two opposite facing rims in addition to, or instead of, coupling elements 221 each having two opposite facing rims—resulting in more possible sign positions.

FIGS. 7 through 10 illustrate examples of system 20 being mounted to a structure 40 in different applications. In each of FIGS. 7 through 10, element 41 represents a shelf or some part of structure 40, and an employee or a customer would view a sign 30 from the right side of the figure. Sign 30 would be mounted to extension element 212.

Figures 7, 8, 9, 10:
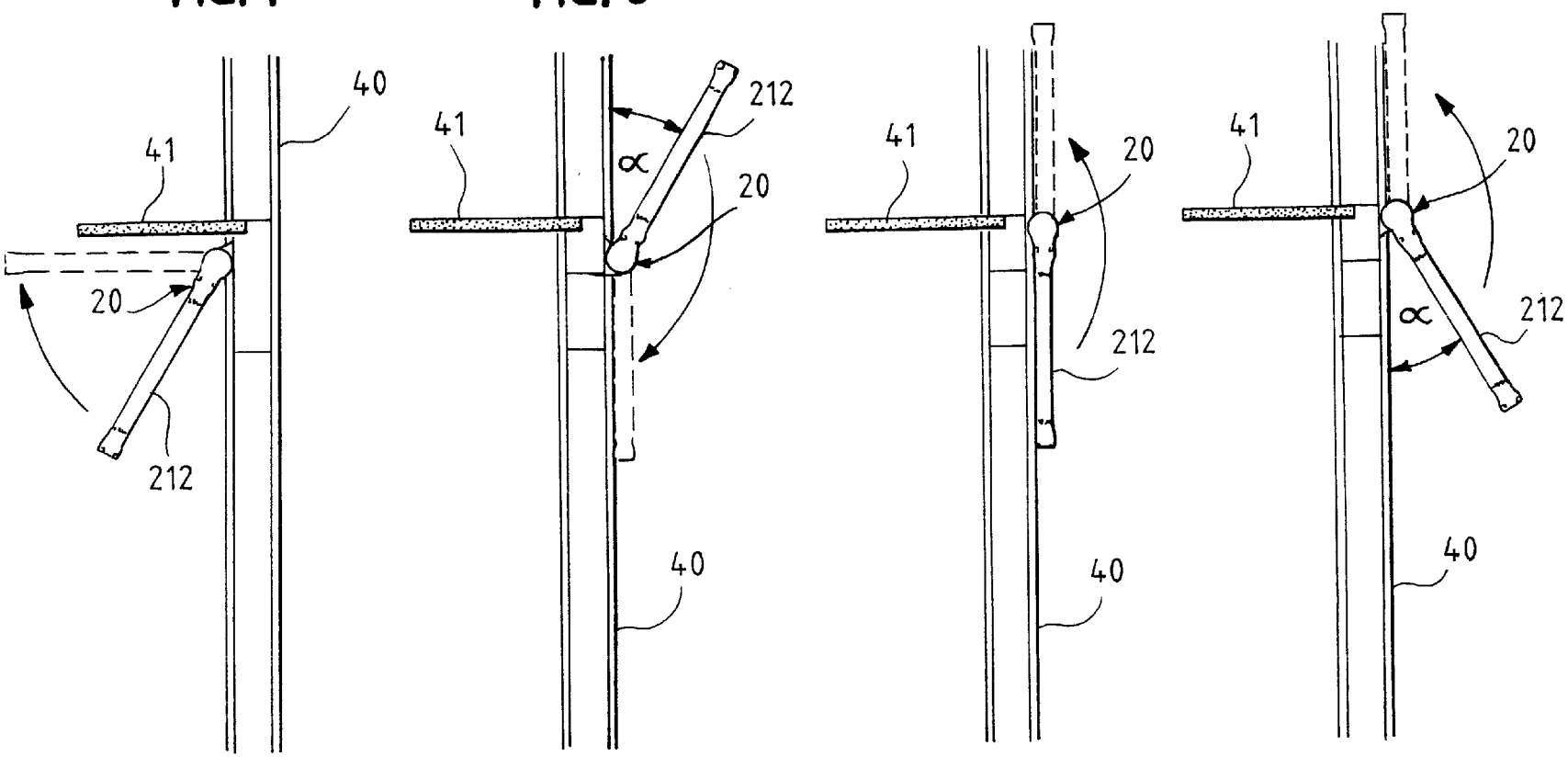
FIG. 7 is a side view of an embodiment of a multi-position sign mounting system in a header mount.
FIG. 8 is a side view of an embodiment of a multi-position sign mounting system in a high beam mount.
FIG. 9 is a side view of an embodiment of a multi-position sign mounting system in a flush beam mount.
FIG. 10 is a side view of an embodiment of the a multi-position sign mounting system in a low beam mount.

FIG. 7 illustrates a header mount application, in which one typically looks up to view the sign 30. Extension element 212 can be in one snap-lock position at the best angle for viewing the sign 30, and then rotated into another horizontal snap-lock position (which can position the sign 30 under a higher shelf or a ceiling) for restocking the lower shelf without damaging or removing the sign 30.

FIG. 8 illustrates a high beam mount application, in which one also typically looks up to view the sign 30. In this application, extension element 212 positions the sign 30 in a first position at a best angle for viewing. Extension element 212 can be rotated down to a vertical snap-lock position for restocking the higher shelf without damaging or removing the sign 30. As will be recognized by those skilled in the art, the first position can use a free rotation with spring return arrangement, allowing free rotation through angle $\alpha$ with spring return. In that way, the sign 30 would yield if hit by a person or a machine such as a fork lift, and then would return to the desired position without being damaged. FIG. 1 illustrates this application in part with extension element 212 shown in phantom after the spring 222 is compressed and the frame portion 21 is rotated through angle $\alpha$. On the top of FIG. 1, part of extension element 212 is shown in phantom in a snap-lock position.

FIG. 9 illustrates a flush beam mount application. In this application, one typically views the sign 30 at about eye level. Extension element 212 can be configured to rotate up to another vertical snap-lock position for restocking the lower shelf without damaging or removing the sign 30.

FIG. 10 illustrates a low beam mount application, in which one typically looks down to view the sign 30. Extension element 212 can position sign 30 in a first position at a best angle for viewing. Extension element 212 can be rotated up to a vertical snap-lock position for restocking the lower shelf without damaging or removing the sign 30. The first position can be a free rotation with spring return position, allowing free rotation through angle $\alpha$ with a spring return. In that way, the sign 30 would yield if hit by a person or a machine such as a fork lift, and then return to the desired position without being damaged.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A sign-mounting system for mounting a sign to a structure, the system comprising:

a frame portion mountable to the sign, the frame portion having a first coupling element; and a mounting portion mountable to the structure, the mounting portion having a second coupling element;

one of the first and second coupling elements defining an inner rim with a generally circular outside surface, and the other of the first and second coupling elements defining an outer rim with a generally circular inside surface, wherein the inner rim fits generally concentrically within the outer rim;

the outside surface defining at least one inner locking-surface part having a radius that is different than a radius of adjacent portions of the outside surface, the inside surface defining at least one outer locking-surface part having a radius that is different than a radius of adjacent portions of the inside surface; wherein the inner rim fits within the outer rim in at least two orientations in which at least one of the at least one inner locking-surface parts and at least one of the at least one outer locking-surface parts engage each other to resist rotation of the first and second coupling elements relative to each other;

wherein at least one of the at least one inner locking-surface parts has an arc length that is different than an arc length of at least one of the at least one outer locking-surface parts; wherein the respective locking-surface parts with different arc lengths engage one another providing a limited range of rotation of the first and second coupling elements relative to each other, and wherein the system further includes a biasing element engaged with the first and second coupling elements, to bias the the first and second coupling elements relative to each other.

2. A sign-mounting system as in claim 1, wherein the biasing element is a spirally compressed spring.

3. A sign-mounting system as in claim 1, wherein the biasing element is positioned generally concentrically within the inner rim.

4. A sign-mounting system for mounting a sign to a structure, the system comprising:

a frame portion mountable to the sign, the frame portion having a first coupling element; and a mounting portion mountable to the structure, the mounting portion having a second coupling element;

one of the first and second coupling elements defining an inner rim with a generally circular outside surface, and the other of the first and second coupling elements defining an outer rim with a generally circular inside surface, wherein the inner rim fits generally concentrically within the outer rim;

the outside surface defining at least one inner locking-surface part having a radius that is different than a radius of adjacent portions of the outside surface, the inside surface defining at least one outer locking-surface part having a radius that is different than a radius of adjacent portions of the inside surface; wherein the inner rim fits within the outer rim in at least two orientations in which at least one of the at least one inner locking-surface parts and at least one of the at least one outer locking-surface parts engage each other to resist rotation of the first and second coupling elements relative to each other;

wherein the mounting portion further includes a plurality of connecting points for mounting the system at different orientations with respect to the structure.

5. A sign-mounting system for mounting a sign to a structure, the system comprising:

a frame portion mountable to the sign, the frame portion having a first coupling element; and a mounting portion mountable to the structure, the mounting portion having a second coupling element;

one of the first and second coupling elements defining an inner rim with a generally circular outside surface, and the other of the first and second coupling elements defining an outer rim with a generally circular inside surface, wherein the inner rim fits generally concentrically within the outer rim;

the outside surface defining at least one inner locking-surface part having a radius that is different than a radius of adjacent portions of the outside surface, the inside surface defining at least one outer locking-surface part having a radius that is different than a radius of adjacent portions of the inside surface; wherein the inner rim fits within the outer rim in at least two orientations in which at least one of the at least one inner locking-surface parts and at least one of the at least one outer locking-surface parts engage each other to resist rotation of the first and second coupling elements relative to each other;

wherein the frame portion further includes an extension element mountable to the sign, the extension element joined to the first coupling element and being adjustable to different lengths.

6. A sign-mounting system as in claim 5, wherein the extension element is adjustable telescopically.

7. A sign-mounting system for mounting a sign to a structure, the system comprising:

a frame portion mountable to the sign, the frame portion having a first coupling element; and a mounting portion mountable to the structure, the mounting portion having a second coupling element;

one of the first and second coupling elements defining an inner rim with a generally circular outside surface, and the other of the first and second coupling elements defining an outer rim with a generally circular inside surface, wherein the inner rim fits generally concentrically within the outer rim;

the outside surface defining at least one inner locking-surface part having a radius that is different than a radius of adjacent portions of the outside surface, the inside surface defining at least one outer locking-surface part having a radius that is different than a radius of adjacent portions of the inside surface; wherein the inner rim fits within the outer rim in at least two orientations in which at least one of the at least one inner locking-surface parts and at least one of the at least one outer locking-surface parts engage each other to resist rotation of the first and second coupling elements relative to each other;

wherein the inner and outer rims are formed from polypropylene.

8. A sign-mounting system for mounting a sign to a structure, the system comprising:

a frame portion mountable to the sign, the frame portion having a first coupling element; and a mounting portion mountable to the structure, the mounting portion having a second coupling element;

one of the first and second coupling elements defining an inner rim with a generally circular outside surface, and the other of the first and second coupling elements defining an outer rim with a generally circular inside surface, wherein the inner rim fits generally concentrically within the outer rim;

the outside surface defining at least one inner locking-surface part having a radius that is different than a radius of adjacent portions of the outside surface, the inside surface defining at least one outer locking-surface part having a radius that is different than a radius of adjacent portions of the inside surface; wherein the inner rim fits within the outer rim in at least two orientations in which at least one of the at least one inner locking-surface parts and at least one of the at least one outer locking-surface parts engage each other to resist rotation of the first and second coupling elements relative to each other;

the frame portion further including a third coupling element being a mirror image of the first coupling element, an extension element extending from each of the first and third coupling elements, and at least one central element which is joined to each of the extension elements, and the mounting portion further including a fourth coupling element, the fourth coupling element being a mirror image of the second coupling element, wherein the first and second coupling elements couple with each other, and the third and fourth coupling elements couple with each other.

9. A sign-mounting system for mounting a sign to a structure, the system comprising:

a frame portion mountable to the sign, the frame portion including a first coupling element; and a mounting portion mountable to the structure, the mounting portion including a second coupling element, wherein one of the first and second coupling elements defines a generally circular first rim, and the other of the first and second coupling elements is reversible and defines a generally circular second rim and an opposite-facing generally circular third rim, and wherein the first rim is configured to engage both the second and third rims, one at a time, in a generally concentric coupling relation.

10. A sign-mounting system as in claim 9, the first rim defining at least one first locking part having a radius that is different than a radius of adjacent portions of the first rim, and the second rim defining at least one second locking part having a radius that is different than a radius of adjacent portions of the second rim, wherein the first and second rims engage one another in at least two orientations in which at least one of the at least one first locking parts and at least one of the at least one second locking parts engage to resist rotation of the first and second coupling elements relative to each other.

11. A sign-mounting system as in claim 10, wherein the third rim defines at least one third locking part having a radius that is different than a radius of adjacent portions of the third rim, and wherein the first and third rims engage one another in at least two orientations in which at least one of the at least one first locking parts and at least one of the at least one third locking parts engage to resist rotation of the first and second coupling elements relative to each other.

12. A sign-mounting system as in claim 10, wherein the third rim defines at least one third locking part having a radius that is different than a radius of adjacent portions of the third rim, wherein at least one of the at least one first locking parts has an arc length that is different than an arc length of at least one of the at least one third locking parts, and wherein the first and third rims engage one another in an orientation in which the at least one of the at least one first locking parts and the at least one of the at least one third locking parts can be engaged to resist rotation, beyond a limited range of rotation, of the first and second coupling elements relative to each other, and wherein the system further includes a spring for biasing rotation of the first and second coupling elements relative to each other in one direction, when one end of the spring is in contact with the first coupling element and another end of the spring is in contact with the second coupling element.

13. A sign-mounting system as in claim 9, the first rim defining at least one first locking part having a radius that is different than a radius of adjacent portions of the first rim, and the second rim defining at least one second locking part having a radius that is different than a radius of adjacent portions of the second rim;

wherein at least one of the at least one first locking parts has an arc length that is different than an arc length of at least one of the at least one second locking parts, wherein the first and second rims engage one another in an orientation in which the at least one of the at least one first locking parts and the at least one of the at least one second locking parts engage to resist rotation, beyond a limited range of rotation, of the first and second coupling elements relative to each other, and wherein the system further includes a spring for biasing rotation of the first and second coupling elements relative to each other in one direction, when one end of the spring is in contact with the first coupling element and another end of the spring is in contact with the second coupling element.

14. A sign-mounting system as in claim 13, wherein the third rim defines at least one third locking part having a radius that is different than a radius of adjacent portions of the third rim, wherein at least one of the at least one first locking parts has an arc length that is different than an arc length of at least one of the at least one third locking parts, and wherein the first and third rims engage one another in an orientation in which the at least one of the at least one first locking parts and the at least one of the at least one third locking parts engage to resist rotation, beyond a limited range of rotation, of the first and second coupling elements relative to each other.

15. A sign-mounting system as in claim 9, wherein the frame portion further includes an extension element mountable to the sign, the extension element joined to the first coupling element and being adjustable to different lengths.

16. A sign-mounting system as in 15, claim wherein the extension element is adjustable telescopically.

17. A sign-mounting system as in claim 9, wherein the first, second and third rims are formed from polypropylene.

18. A sign-mounting system as in claim 9, the frame portion further including a third coupling element being a mirror image of the first coupling element, an extension element extending from each of the first and third coupling elements, and at least one central element which is joined to each of the extension elements, and the mounting portion further including a fourth coupling element, the fourth coupling element being a mirror image of the second coupling element, wherein the first and second coupling elements couple with each other, and the third and fourth coupling elements couple with each other.

19. A sign-mounting system as in claim 9, wherein the one, of the first and second coupling elements, defining the first rim is reversible and further defines a generally circular fourth rim, the fourth rim facing opposite the first rim, and wherein the fourth rim is configured to engage the second and the third rims, one at a time, in a generally concentric coupling relation.

* * * * *

UNITED STATES PATENT AND TRADEMARK OFFICE

CERTIFICATE OF CORRECTION

PATENT NO. : 6,378,818 B1 
DATED : April 30, 2002
INVENTOR(S) : Padiak et al.

It is certified that error appears in the above-identified patent and that said Letters Patent is hereby corrected as shown below:

Column 11,
Line 14, please delete "15, claim", and insert therefor -- claim 15, --.

Signed and Sealed this

Eighteenth Day of June, 2002

*Attest:*

*Attesting Officer*

JAMES E. ROGAN
*Director of the United States Patent and Trademark Office*